United States Patent [19]

Kaanders

[11] 4,041,251

[45] Aug. 9, 1977

[54] HEARING AID TO BE WORN BEHIND THE EAR OF THE USER AND PROVIDED WITH A PRESSURE-GRADIENT MICROPHONE

[75] Inventor: Johannes Matheus Gerardus Maria Kaanders, Eindhoven, Netherlands

[73] Assignee: U.S. Philips Corporation, New York, N.Y.

[21] Appl. No.: 622,998

[22] Filed: Oct. 16, 1975

Related U.S. Application Data

[63] Continuation of Ser. No. 483,614, June 27, 1974, abandoned.

[51] Int. Cl.[2] ..... H04R 1/38; H04R 25/00

[52] U.S. Cl. ..... 179/107 FD

[58] Field of Search ..... 179/1 DM, 107 FD, 107 H, 179/107 R, 121 R, 121 D, 180; 181/156, 158, 160, 166

[56] References Cited

U.S. PATENT DOCUMENTS

| | | | |
|---|---|---|---|
| 2,417,153 | 3/1947 | Darr | 179/107 R |
| 2,702,318 | 2/1955 | Dvorsky | 179/180 |
| 2,938,083 | 5/1960 | Herrmann | 179/107 H |
| 3,053,339 | 9/1962 | Kanesuke et al. | 179/1 DM |
| 3,439,128 | 4/1969 | Sobel et al. | 179/121 R |
| 3,662,124 | 5/1972 | Hassler et al. | 179/107 FD |
| 3,749,853 | 7/1973 | Ely et al. | 179/107 H |
| 3,777,079 | 12/1973 | Fischer et al. | 179/107 FD |
| 3,798,390 | 3/1974 | Gage et al. | 179/107 FD |
| 3,876,843 | 4/1975 | Moen | 174/107 FD |
| 3,895,194 | 7/1975 | Fraim | 179/121 R |
| 3,963,881 | 6/1976 | Fraim et al. | 179/121 D |

FOREIGN PATENT DOCUMENTS

| | | | |
|---|---|---|---|
| 1,263,849 | 3/1968 | Germany | 179/107 E |
| 1,219,561 | 1/1971 | United Kingdom | 179/111 R |

*Primary Examiner*—George G. Stellar
*Attorney, Agent, or Firm*—Frank R. Trifari; Bernard Franzblau

[57] ABSTRACT

A hearing aid to be worn behind the ear and including a pressure-gradient microphone is designed so as to give a defined directional effect. The rear surface of the microphone communicates with the ambient atmosphere by way of an acoustic resistor comprising a block of sintered material. The overall transmission area of this block is less than one half of the effective area of the microphone diaphragm. The block preferably is detachably accommodated in a rubber mount and may comprise sintered bronze pellets or sintered silicon carbide.

10 Claims, 2 Drawing Figures

HEARING AID TO BE WORN BEHIND THE EAR OF THE USER AND PROVIDED WITH A PRESSURE-GRADIENT MICROPHONE

This is a continuation, of application Ser. No. 483,614, filed June 27, 1974, now abandoned.

The invention relates to a hearing aid to be worn behind the ear and provided with a pressure-gradient microphone which is connected to a frontal sound entrance aperture and to a dorsal sound entrance aperture located at the rear of the microphone and comprising a plurality of capillary channels.

Such a hearing aid is described in German Patent Specification No. 1,277,347.

The invention is characterized in that the capillary channels are formed by a block of a sintered material the overall transmission area of which is less than one half of the effective area of the microphone diaphragm. This provides the advantage over the known hearing aid that an optimal directional characteristic is obtained by improved matching of the resistance value of the acoustic filter formed by the capillary channels. It should be noted that in microphone technology it has long been known to use acoustic resistors made of a sintered material. However, so far these acoustic resistors have not been used in the small-size behind-the-ear hearing aids because of their bulk.

Their use is made possible, however, if the frontal sound entrance aperture is substantially at right angles to the sound entrance aperture at the rear of the microphone.

As a result the microphone will be located slightly inwardly in the hearing aid so that space for accommodating the acoustic filter made of sintered material becomes available.

An embodiment of the invention is characterized in that the block is detachably positioned in a rubber mount. This permits replacement of a filter which may have become fouled during use of the behind-the-ear hearing aid.

The hearing aid may further be provided with a screening hood which has at least one sound entrance aperture and is clamped around an edge of the rubber mount.

The sintered material of the acoustic filter may be sintered pellets of bronze or sintered silicon carbide.

Figure 1:
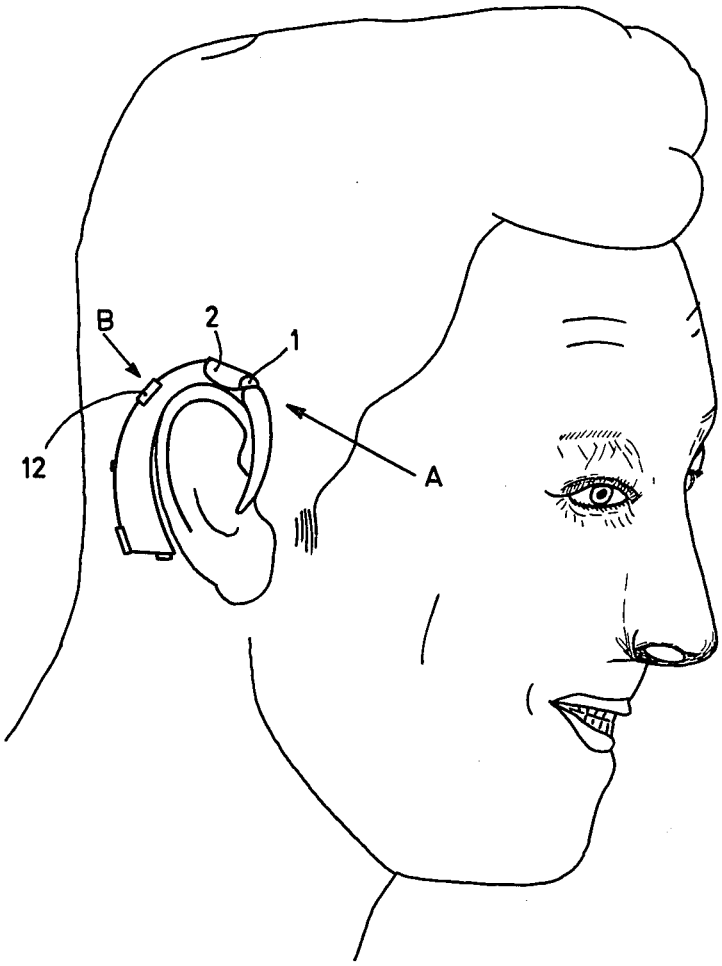
Figure 2:
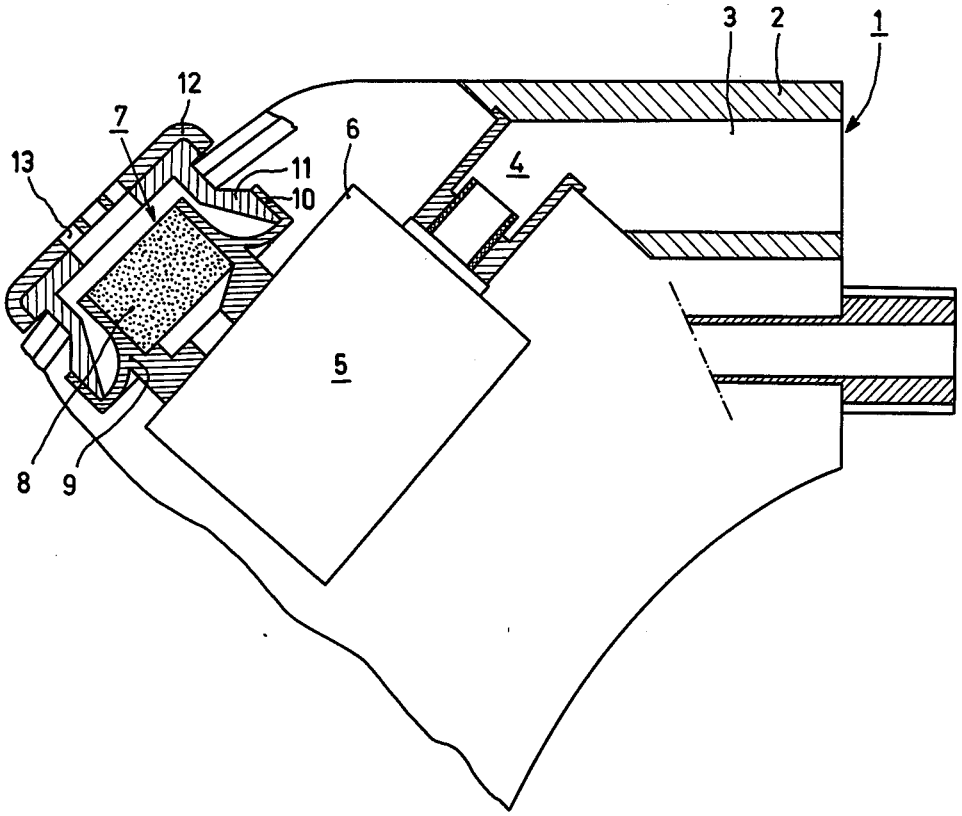

An embodiment of the invention will now be described by way of example with reference to the accompanying diagrammatic drawings in which:

FIG. 1 illustrates how a hearing aid according to the invention is worn behind the ear, and FIG. 2 is a sectional view of the novel hearing hearing aid.

FIG. 1 shows a hearing aid according to the invention which is worn behind the ear by the user. The apparatus is directed to the front. Sound arriving from the direction of the arrow A enters a frontal sound entrance aperture 1 and reaches a built-in microphone (not shown) through a transparent cap 2 which forms a duct.

A screening head 12 provided with a plurality of sound entrance apertures is located at the rear. The apertures communicate with the rear surface of the diaphragm of the microphone. Sound enters these apertures in the direction indicated by an arrow B.

FIG. 2 is a sectional view of the hearing aid. The frontally entering sound passes through the aperture 1 and a duct 3 to the entrance 4 of a microphone 5 of the electret capacitor type. The rear surface of the diaphragm (not shown) of the microphone 5 communicates with the ambient atmosphere through a lateral wall 6 and an acoustic filter 7.

This acoustic filter consists of a filter block 8 made up of sintered bronze pellets having a diameter of about 100 μm. The filter block 8 is detachably clamped in a rubber mount 9 which has an edge 10 embracing a ring 11 made of a synthetic material. This ring is embraced in its turn by a screening hood 12 formed with a plurality of sound entrance apertures 13. The opening of the ring 11 registers with the apertures 13.

The dimensions of the filter block are: diameter = 3.0 mm and height = 1.8 mm. The microphone has a diaphragm of electret foil the effective area of which is 4 mm by 6 mm. The ratio of the transmission area of the filter block and the effective area of the microphone diaphragm is about 1/5 because it was found that this ratio gives the best directional characteristic of the hearing aid.

What is claimed is:

1. A directional hearing aid to be worn behind the ear comprising, a pressure-gradient microphone containing a vibratory diaphragm and having a first sound admitting opening in a front wall of the microphone case and a second sound admitting opening in a lateral wall thereof and which communicates with the rear surface of the diaphragm whereby sound is transmitted to both sides of the diaphragm, a crescent shaped housing inside of which the microphone is mounted, said housing including acoustic duct means having a frontal sound entrance aperture coupled to said microphone first sound admitting opening and a dorsal sound entrance aperture located rearwardly of the frontal sound entrance aperture and coupled to said microphone second sound admitting opening, an acoustic impedance positioned outside of the microphone case between the dorsal aperture and said second sound admitting opening and comprising a body of sintered material forming capillary ducts through which the sound must pass to reach said second sound admitting opening, the overall sound transmission area of said body being less than one half of the effective area of the microphone diaphragm, and a resilient mount having an opening on one face thereof and a recess in which said sintered body is mounted so as to be readily removable from the mount via said opening therein, said mount being located external of the microphone case and within said housing so that the sintered body is positioned normal to at least one of said microphone sound admitting openings.

2. A directional hearing aid to be worn behind the ear comprising, a pressure-gradient microphone housing a vibratory diaphragm, acoustic duct means having a frontal sound entrance aperture coupled to a first sound admitting access opening of the microphone and a dorsal sound entrance aperture located to the rear of the microphone and coupled to a second sound admitting access opening of the microphone that communicates with the rear surface of the diaphragm, said frontal sound aperture being located substantially at right angles to the dorsal sound entrance aperture, an acoustic impedance coupled between said dorsal aperture and said second access opening and comprising a block of sintered material forming a plurality of capillary ducts, the overall sound transmission area of said block being less than one half of the effective area of said microphone diaphragm, and a rubber mount in which the block is detachably accomodated.

3. A hearing aid as claimed in claim 2 wherein the mount along its periphery has an edge which is clampingly embraced by a screening hood formed with at least one sound entrance aperture.

4. A directional hearing aid to be worn behind the ear comprising, a pressure-gradient microphone housing a vibratory diaphragm, acoustic duct means having a frontal sound entrance aperture coupled to a first sound admitting access opening located in a front wall of the microphone housing and a dorsal sound entrance aperture located to the rear of the microphone and coupled to a second sound admitting access opening located in a lateral wall of the microphone housing that communicates with the rear surface of the diaphragm, said frontal sound aperture being located substantially at right angles to the dorsal sound entrance aperture, and an acoustic impedance coupled between said dorsal aperture and said second access opening and comprising a block of sintered material forming a plurality of capillary ducts, said block of sintered material being mounted external to the microphone housing and within the acoustic duct means and having diameter to height dimensions in the ratio of approximately 3:2 and with the overall sound transmission area of said block being less than one half of the effective area of said microphone diaphragm.

5. A hearing aid as claimed in claim 4 wherein the sintered material comprises sintered bronze pellets.

6. A miniature directional hearing aid to be worn behind the ear comprising, a pressure-gradient microphone containing a vibratory diaphragm and having a first sound admitting opening in a front wall of the microphone case and a second sound admitting opening in a lateral wall thereof and which communicates with the rear surface of the diaphragm whereby sound is transmitted to both sides of the diaphragm, a crescent shaped housing inside of which the microphone is mounted, said housing including acoustic duct means having a frontal sound entrance aperture coupled to said microphone first sound admitting opening and a dorsal sound entrance aperture located rearwardly of the frontal sound entrance aperture and coupled to said microphone second sound admitting opening, and an acoustic impedance positioned outside of the microphone case between the dorsal aperture and said second sound admitting opening and comprising a body of sintered material forming capillary ducts through which the sound must pass to reach said second sound admitting opening, the overall sound transmission area of said body being less than one half of the effective area of the microphone diaphragm.

7. A hearing aid as claimed in claim 6 wherein the sintered material comprises sintered silicon earbide.

8. A hearing aid as claimed in claim 6 wherein the ratio of the sound transmission area of the sintered block to the effective area of the microphone diaphragm is approximately 1 to 5.

9. A hearing aid as claimed in claim 6 wherein the sintered body comprises a block having diameter to height dimensions in the ratio of approximately 3:2.

10. A hearing aid as claimed in claim 9 wherein the ratio of sound transmission area of the sintered block to the effective area of the microphone diaphragm is approximately 1 to 5 and the sintered block is the sole acoustic impedance located between the rear surface of the diaphragm and said dorsal sound entrance aperture in the housing.

* * * * *

UNITED STATES PATENT OFFICE

CERTIFICATE OF CORRECTION

Patent No. 4,041,251 Dated August 9, 1977

Inventor(s) JOHANNES M.G.M. KAANDERS

It is certified that error appears in the above-identified patent and that said Letters Patent are hereby corrected as shown below:

IN THE CLAIMS

Claim 7, line 2, "earbide" should read --carbide--.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*